US011993885B2

(12) United States Patent
Lee

(10) Patent No.: US 11,993,885 B2
(45) Date of Patent: May 28, 2024

(54) WASHING MACHINE AND CONTROL METHOD THEREOF

(71) Applicant: LG ELECTRONICS INC., Seoul (KR)

(72) Inventor: Phal Jin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 155 days.

(21) Appl. No.: 17/612,380

(22) PCT Filed: Jul. 15, 2020

(86) PCT No.: PCT/KR2020/009341
§ 371 (c)(1),
(2) Date: Nov. 18, 2021

(87) PCT Pub. No.: WO2021/010755
PCT Pub. Date: Jan. 21, 2021

(65) Prior Publication Data

US 2022/0251755 A1 Aug. 11, 2022

(30) Foreign Application Priority Data

Jul. 17, 2019 (KR) ..... 10-2019-0086536

(51) Int. Cl.
*D06F 34/20* (2020.01)
*D06F 37/42* (2006.01)
(Continued)

(52) U.S. Cl.
CPC ..... *D06F 34/20* (2020.02); *D06F 37/42* (2013.01); *D06F 2103/40* (2020.02); *D06F 2105/44* (2020.02); *D06F 2105/60* (2020.02)

(58) Field of Classification Search
CPC ..... D06F 37/42
See application file for complete search history.

(56) References Cited

U.S. PATENT DOCUMENTS 9,109,319 B2 8/2015 Astrauskas
2003/0037382 A1 2/2003 Broker
(Continued)

FOREIGN PATENT DOCUMENTS

CN 103741431 4/2014
CN 104562546 4/2015
(Continued)

OTHER PUBLICATIONS

WO2018099296A1 Machine Translation (Year: 2018).*
(Continued)

*Primary Examiner* — Spencer E. Bell
(74) *Attorney, Agent, or Firm* — Fish & Richardson P.C.

(57) ABSTRACT

Disclosed are a washing machine capable of preventing the occurrence of an accident related to a child or pet becoming trapped inside a washing tub and a control method thereof. The washing machine according to an aspect of the present disclosure includes a sound sensor configured to sense a sound measured at a washing tub, a controller configured to control a door and the washing tub according to a safe mode based on a sound sensed by the sound sensor, and a release signal sensor configured to sense a release signal to switch the door and the washing tub, controlled according to the safe mode by the controller, back to a normal mode.

5 Claims, 7 Drawing Sheets

(51) Int. Cl.

| | |
|---|---|
| ***D06F 103/40*** | (2020.01) |
| ***D06F 105/44*** | (2020.01) |
| ***D06F 105/60*** | (2020.01) |

(56) References Cited

U.S. PATENT DOCUMENTS

| | | | | |
|---|---|---|---|---|
| 2011/0260553 | A1* | 10/2011 | Poyner ..... | A47L 15/0049 307/115 |
| 2012/0235514 | A1 | 9/2012 | Astrauskas | |
| 2017/0268924 | A1 | 9/2017 | Shin et al. | |

FOREIGN PATENT DOCUMENTS

| | | |
|---|---|---|
| CN | 108118489 | 6/2018 |
| EP | 2048274 | 4/2009 |
| EP | 2067429 | 6/2009 |
| KR | 100603981 | 7/2006 |
| KR | 101622597 | 5/2016 |
| KR | 20170107281 | 9/2017 |
| KR | 10-2019-0023446 | 3/2019 |
| KR | 20190023446 | 3/2019 |
| WO | WO 2017/128405 | 8/2017 |
| WO | WO-2018099296 A1 * | 6/2018 |

OTHER PUBLICATIONS

Office Action in Chinese Appln. No. 202080039997.5, dated Feb. 15, 2023, 23 pages (with English translation).
Extended Search Report in European Appln. No. 20840299.0, dated Jul. 12, 2023, 17 pages.

* cited by examiner

WASHING MACHINE AND CONTROL METHOD THEREOF

CROSS-REFERENCE TO RELATED APPLICATIONS

This present application is a National Stage application under 35 U.S.C. § 371 of International Application No. PCT/KR2020/009341, filed on Jul. 15, 2020, which claims the benefit of priority to Korean Patent Application No. 10-2019-0086536, entitled "WASHING MACHINE AND CONTROL METHOD THEREOF," filed on Jul. 17, 2019, in the Korean Intellectual Property Office, the entire disclosure of which is incorporated herein by reference.

BACKGROUND

1. Technical Field

The present disclosure relates to a washing machine capable of preventing the occurrence of an accident related to a child or pet becoming trapped inside a washing tub and a control method thereof.

2. Description of Related Art

In general, a washing machine is an apparatus that washes laundry using the emulsifying effect of detergent, the frictional force of a water stream made by rotation of a washing blade, and impacts applied by the washing blade. Such washing machines mainly use an electric motor as a main power source, and remove contaminants from clothing by performing a washing process, a rinsing process, and a dehydrating process using the action of detergent and water.

Washing machines are classified as a cylinder type, an agitator type, and a pulsator type depending on the washing method. While having respectively different detailed structures according to the functions thereof, these types of washing machines commonly include a washing tub, into which laundry is introduced and in which washing, rinsing and dehydrating processes are performed, and a door for opening and closing a laundry entrance formed in one surface of the washing tub.

Due to this structure of the washing machine, if a child or pet enters the washing tub while the laundry entrance is open, and the door is then closed, it may be difficult for the child or pet to open the door by himself or herself. Accordingly, accidents due to depletion of oxygen in the washing tub or due to operation of the washing machine may occur.

For this reason, in order to prevent the occurrence of these accidents, which may occur in the course of using the washing machine, it is desirable to prevent children or pets from entering the washing tub, or to induce an immediate reaction from the child or pet that has entered the washing tub.

Further, since the above accidents have the potential to lead to severe injury or even death, the safety of the child or pet must first and foremost be ensured in cases where there is concern that the above accidents may occur, even if it means restricting the operation of the washing machine. This restriction of the operation of the washing machine should then be released only once the safety of the child or pet has been confirmed.

However, if the operation of the washing machine is restricted based simply on the concern that an accident may occur, even when it is not established that there is a child or pet in the washing tub, the user may frequently be inconvenienced by being unable to operate the washing machine as he or she intends.

Therefore, there is a need for a process to allow the operation of the washing machine to be initially restricted when there is a concern of the above accidents occurring and then to allow the restriction to be released based on reliable grounds, while also allowing this process to take place easily from the perspective of the user.

In addition, depending on the behavior patterns of a child or pet, various different situations may occur when the child or pet enters the washing tub. For example, the child or pet may actively move around inside the washing tub, or in contrast the child or pet may simply be present in the washing tub without making any movements or sounds.

If the child or pet actively moves around inside the washing tub, the presence of the child or pet may easily be sensed by means of various sensors. However, if the child or pet is simply present in the washing tub without making any movements or sounds, sensing the same may be difficult.

Therefore, when sensing the presence of a child or pet in the washing tub, rather than simply relying on passively obtained information for sensing, it is further desirable to take proactive steps for sensing in cases where it may be difficult to sense the child or pet in the washing tub.

Regarding the above accidents affecting a washing machine, Korean Patent Registration No. 10-0603981 (hereinafter referred to as "Related Art Document 1") discloses a child lock apparatus and method of a drum washing machine.

In detail, Related Art Document 1 discloses a feature in which, by interrupting an operation mode signal input to a key input interface of a drum washing machine and an on/off switching signal of a power switch, unintended operation of the drum washing machine caused by indiscriminate operation by a child may be prevented, and the child may accordingly be protected from the risk of an accident related to such unintended operation.

However, the drum washing machine in Related Art Document 1 has no relation to accidents occurring due to a child entering the washing machine, and is thus unable to prevent such accidents in advance.

Furthermore, although a feature of executing the child lock of the drum washing machine in order to prevent accidents is disclosed, there is no specific consideration regarding releasing of the child lock.

Further, Korean Patent Registration No. 10-1622597 (hereinafter referred to as "Related Art Document 2") discloses a method of indicating an accident in a drum washing machine and a washing machine implementing the method.

In detail, Related Art Document 2 discloses a feature in which, in the case of a child or pet being trapped inside a washing tub by a door, movement of an object inside the drum may be sensed by means of a vibration sensor, and notification thereof may be externally output as a message by means of a buzzer or speaker, thereby preventing the occurrence of an accident.

However, the washing machine in Related Art Document 2 is limited to sensing the case where a child or pet is trapped in the washing tub and externally outputting notification thereof, and discloses no feature related to preventing children or pets from becoming trapped in the washing tub in advance.

Furthermore, the washing machine in Related Art Document 2 is only able to sense the presence of an object in the drum when the object moves in the drum, and is thus unable to sense a child or pet in the washing tub when the child or pet is simply present in the washing tub without making any movements or sounds.

As such, although directed to preventing the occurrence of accidents related to a child or pet becoming trapped inside the washing tub, the washing machines of the related art are unable to satisfactorily do so.

SUMMARY OF THE INVENTION

The present disclosure has been made in an effort to solve the above-described problems associated with the conventional washing machine.

Specifically, the present disclosure is directed to preventing the occurrence of accidents related to a child or pet becoming trapped inside a washing tub, both by preventing the child or pet from entering the washing tub in advance and by inducing an immediate reaction from the child or pet that has entered the washing tub.

In addition, the present disclosure is further directed to, when operation of the washing machine has been restricted due to the concern that an accident may occur, providing a process to allow the restriction to be released based on reliable grounds, while also allowing such a process to take place easily from the perspective of the user.

In addition, the present disclosure is still further directed to enabling effective sensing of the presence of a child or pet in the washing tub even in situations in which such sensing is difficult, and enabling appropriate response measures to be taken in consideration of various behavior patterns of the child or pet that has entered the washing tub.

Aspects of the present disclosure are not limited to the above-mentioned aspects, and other technical aspects not mentioned above will be clearly understood by those skilled in the art from the following description.

In order to accomplish the above and other aspects, a washing machine and a control method thereof according to an aspect of the present disclosure are configured to identify the possibility of an accident occurring by sensing a sound of an object to be protected and to control the washing machine based on the result of identification. In detail, when it is determined that there is the possibility of an accident occurring based on sensing of a sound measured at a washing tub, a warning signal is output, and a door and the washing tub are controlled according to a safe mode.

In addition, the washing machine and the control method thereof according to an aspect of the present disclosure are configured to switch the door and the washing tub, which have been controlled according to the safe mode, back to a normal mode when a release signal, which is generated based on the determination that there is no risk of an accident, is sensed. In detail, after the door and the washing tub are controlled according to the safe mode due to the possibility of an accident occurring, if a release signal set in advance is sensed, it is determined that there is no risk of an accident, and accordingly the door and the washing tub are switched back to the normal mode.

In addition, the washing machine and the control method thereof according to an aspect of the present disclosure are configured to identify in another way the possibility of an accident occurring by inducing a sound from the object to be protected when no sound is sensed. In detail, when it is determined that there is no possibility of an accident occurring based on sensing of a sound measured at the washing tub, a stimulus is applied to an accommodated object accommodated in the washing tub in order to induce a sound therefrom and to sense the induced sound, thereby identifying in another way the possibility of an accident occurring.

In addition, the washing machine and the control method thereof according to an aspect of the present disclosure may separately sense a sound generated inside the washing tub and a sound generated outside the washing tub.

In addition, the washing machine and the control method thereof according to an aspect of the present disclosure may induce a sound from the object to be protected by applying a vibration stimulus to the washing tub.

In addition, the washing machine and the control method thereof according to an aspect of the present disclosure may induce a sound from the object to be protected by applying a sound stimulus to the washing tub.

In addition, the washing machine and the control method thereof according to an aspect of the present disclosure may output a warning signal indicating an approach to the washing tub when it is determined that the sound generated outside the washing tub is a sound of the object to be protected and that the sound of the object to be protected is sensed within a first safe distance.

In addition, the washing machine and the control method thereof according to an aspect of the present disclosure may switch the door to an unlock mode and switch the washing tub to a lock mode when it is determined that the sound generated outside the washing tub is a sound of the object to be protected and that the sound of the object to be protected is sensed within a second safe distance.

In addition, the washing machine and the control method thereof according to an aspect of the present disclosure may switch the door to an unlock mode and switch the washing tub to a lock mode when it is determined that the sound generated or induced inside the washing tub is a sound of an object to be protected.

Technical solutions that may be achieved by the present disclosure are not limited to the above-mentioned technical solutions, and other technical solutions not mentioned above will be clearly understood by those skilled in the art from the following description.

BRIEF DESCRIPTION OF THE DRAWINGS

The above and other aspects, features, and advantages of the present disclosure will become apparent from the detailed description of the following aspects in conjunction with the accompanying drawings, in which.

DETAILED DESCRIPTION

Advantages and features of the present disclosure and methods for achieving them will become apparent from the descriptions of aspects herein below with reference to the accompanying drawings. In relation to describing the present disclosure, when the detailed description of relevant known technology is determined to unnecessarily obscure the gist of the present disclosure, the detailed description may be omitted.

Figure 1:
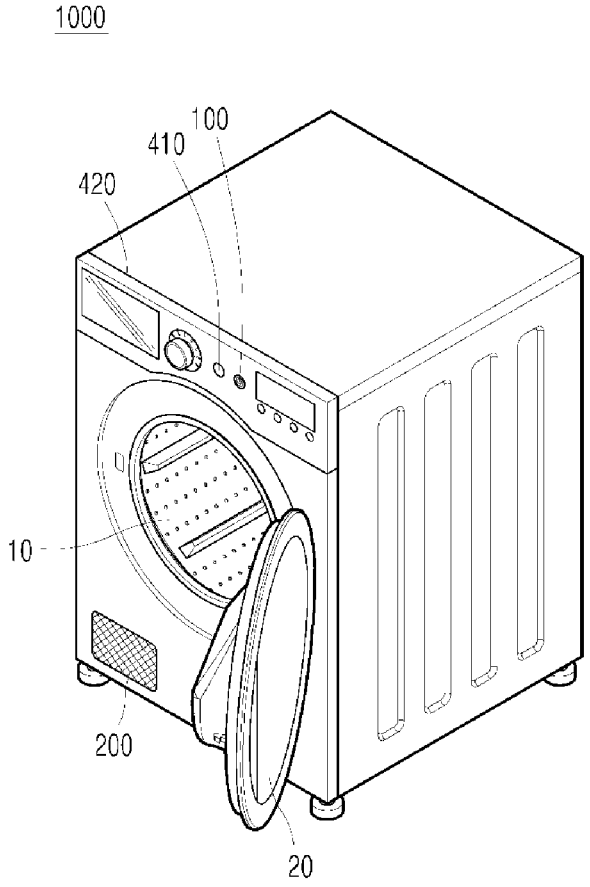
FIG. 1 is a perspective view illustrating a washing machine according to an embodiment of the present disclosure.
Figure 2:
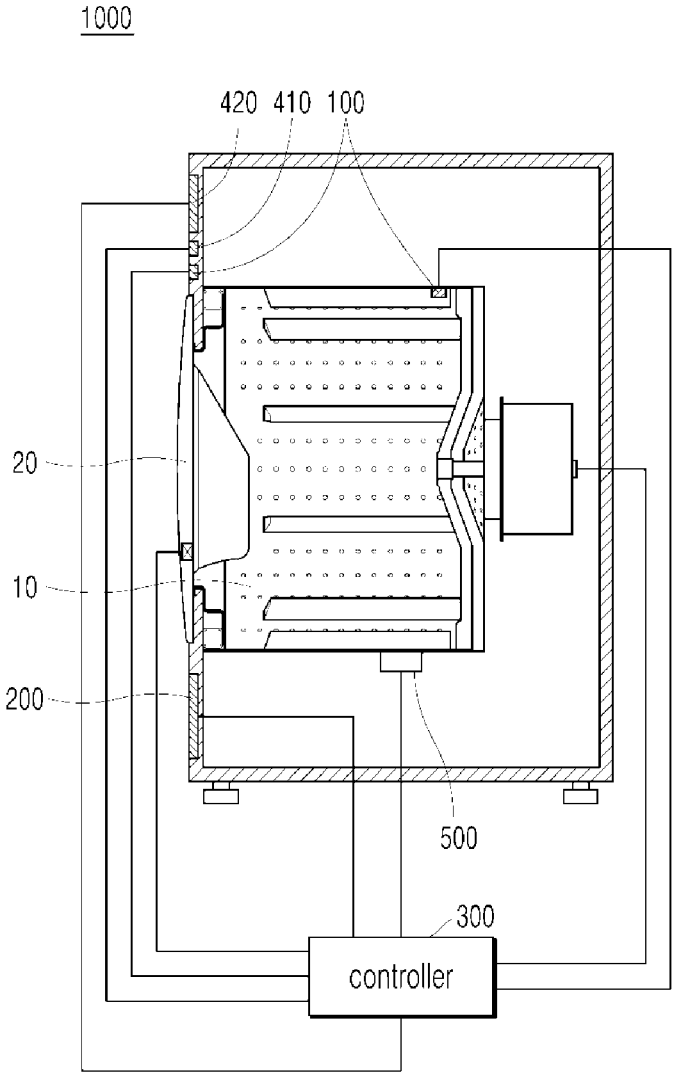
FIG. 2 is a view schematically illustrating main components of the washing machine according to an embodiment of the present disclosure.
Figure 3:
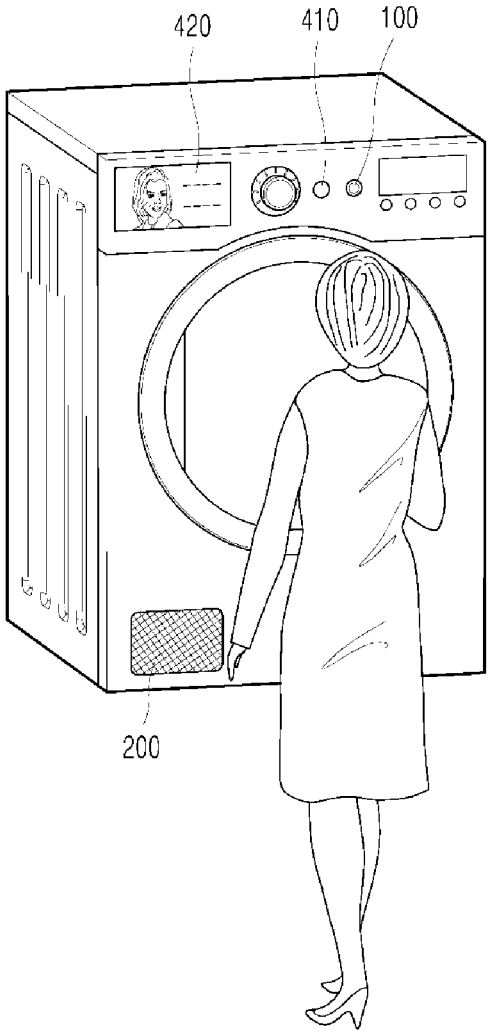
FIG. 3 is a view illustrating a release signal sensor in the washing machine according to an embodiment of the present disclosure.

FIG. 1 is a perspective view illustrating a washing machine according to an embodiment of the present disclosure. FIG. 2 is a view schematically illustrating main components of the washing machine according to an embodiment of the present disclosure. FIG. 3 is a view illustrating a release signal sensor in the washing machine according to an embodiment of the present disclosure.

A washing machine 1000 according to an embodiment of the present disclosure includes a washing tub 10, which is opened and closed by a door 20 in one surface thereof. The washing machine 1000 is capable of performing at least one of a washing process, a rinsing process, a dehydrating process, or a drying process.

The washing tub 10 is a part in which laundry is received in a receiving space therein and in which at least one of the washing process, the rinsing process, the dehydrating process, or the drying process is performed. The washing tub 10 has a laundry entrance formed in one surface thereof through which laundry is introduced.

The laundry entrance is configured to be opened and closed by the door 20. The laundry entrance may be sealed by the door 20 while at least one of the washing process, the rinsing process, the dehydrating process, or the drying process is being performed.

However, since the door 20 may be opened while the washing machine 1000 is in a standby state, there is the possibility of a child or pet entering the washing tub 10 through the open laundry entrance.

In this situation, if the door 20 is then closed, the door 20 may be automatically locked, and it may be difficult for the child or pet to exit the washing tub 10. Furthermore, even if the door 20 is not locked, the child or pet may have difficulty opening the door 20 by himself or herself, and thus accidents due to depletion of oxygen in the washing tub 10 or due to operation of the washing machine 1000 may occur.

In order to prepare for such a situation, as illustrated in FIGS. 1 to 3, the washing machine 1000 according to an embodiment of the present disclosure may include a sound sensor 100, a warning signal output interface 200, a controller 300, and release signal sensors 410 and 420, and may further include a sound inducer 500.

The sound sensor 100 is a part for sensing a sound measured inside the washing tub 10, and identifies the possibility of an accident occurring in the washing tub 10 by sensing a sound made by an object to be protected 30 in the washing tub 10. That is, the situation in which a sound made by the object to be protected 30 is sensed by the sound sensor 100 means that the object to be protected 30 is present within a predetermined range of the washing tub 10, and is thus treated as involving the possibility of an accident occurring.

In this case, the object to be protected 30 refers to an object that may be harmed by an accident if the object enters the washing tub 10, such as a child or a pet. Information on the sound of a child or pet may be registered in advance in the washing machine 1000 in order to identify the object to be protected 30.

Alternatively, information on the sound of a user authorized to operate the washing machine 1000 may be registered in advance, and any sound other than the registered user's sound may be determined to be the sound of an object to be protected 30, whereby the object to be protected 30 may be identified.

The sound sensor 100 may include a microphone mounted in the washing tub 10 in order to sense a sound. As needed, the sound sensor 100 may further include a sound filter in order to sense only a sound in a specific frequency band.

Here, the sound sensor 100 may be mounted both outside and inside the washing tub 10 so as to separately sense a sound generated outside the washing tub 10 and a sound generated inside the washing tub 10. That is, the sound sensor 100 may separately sense whether the sound of the object to be protected 30 is measured outside the washing tub 10 and whether the sound of the object to be protected 30 is measured inside the washing tub 10.

For example, if the sound of the object to be protected 30 is sensed inside the washing tub 10, this indicates that the object to be protected 30 is present in the washing tub 10, and thus immediate measures to ensure the safety of the object to be protected 30 should be taken.

On the other hand, if the sound of the object to be protected 30 is sensed outside the washing tub 10, this indicates that the object to be protected 30 has not yet entered the washing tub 10, and thus precautionary or phased measures to ensure the safety of the object to be protected 30 may be taken.

As described above, the washing machine 1000 according to this embodiment separately senses a sound generated inside the washing tub 10 and a sound generated outside the washing tub 10, and thus it is possible to identify the possibility of the occurrence of accidents according to various different situations in a variety of different ways.

The warning signal output interface 200 is a part for outputting a warning signal based on the sound sensed by the sound sensor 100, and outputs the warning signal when there is the risk of an accident occurring.

In this case, the warning signal is a signal for notifying users in the vicinity of the washing machine 1000 that there is the risk of an accident, and may be implemented as a visual signal, an auditory signal, or a combined visual and auditory signal. For example, as illustrated in FIG. 1, the warning signal output interface 200 may include a speaker mounted in the washing tub 10, and may thereby output an auditory warning signal when necessary.

The controller 300 is a part for controlling the door 20 and the washing tub 10 according to a safe mode based on the sound sensed by the sound sensor 100, and restricts the operation of the washing machine 1000 when there is the possibility of an accident occurring.

In this case, the safe mode refers to a predetermined state in which, when there is the risk of an accident, operation of the washing machine 1000 is restricted to a preset state until it is confirmed that the risk has been eliminated, such that, even when the object to be protected 30 is present in the washing tub 10, no harm comes to the object to be protected 30.

The release signal sensors 410 and 420 are parts for sensing a release signal for switching the door 20 and the washing tub 10, which is controlled according to the safe mode by the controller 300, back to a normal mode, and identify whether the accident risk has been eliminated based on whether a preset release signal has been sensed. That is, in response to the release signal sensors 410 and 420 sensing the preset release signal, the accident risk is treated as having been eliminated.

As a signal by which it can be established that the accident risk has been confirmed to no longer exist, the release signal may be input only by a subject who has been registered in advance as a user authorized to operate the washing machine 1000.

For example, as illustrated in FIG. 3, information on the face of a user authorized to operate the washing machine 1000 may be registered in advance as the release signal via a camera and a screen mounted in the washing tub 10. Accordingly, in the state in which the washing machine 1000 is controlled according to the safe mode, if a registered user approaches the washing machine 1000 and then the release signal sensors 410 and 420 sense the face of the registered user, the washing machine 1000 may be switched back to the normal mode in response thereto.

In addition, information on the voice of a user authorized to operate the washing machine 1000 may be registered in advance as the release signal via a microphone mounted in the washing tub 10. Accordingly, in the state in which the washing machine 1000 is controlled according to the safe mode, if a registered user approaches the washing machine 1000 and then the release signal sensors 410 and 420 sense the voice of the registered user, the washing machine 1000 may be switched back to the normal mode in response thereto.

In addition, even when no specific signal has been registered in advance as the release signal, a user authorized to operate the washing machine 1000 may be induced to speak a specific word via a query and response method, and the specific word may function as the release signal. Accordingly, in the state in which the washing machine 1000 is controlled according to the safe mode, if a registered user approaches the washing machine 1000 and then the release signal sensors 410 and 420 sense an appropriate response to a specific question by the registered user, the washing machine 1000 may be switched back to the normal mode in response thereto.

In cases such as those described above, when approaching the washing machine 1000, a registered user is capable of confirming the presence or absence of the accident risk in a natural manner. Accordingly, since sensing of the release signal can be seen as confirmation that there is no accident risk, the washing machine 1000 may be switched back to the normal mode without the risk of an accident occurring.

The sound inducer 500 is a part for inducing a sound from an accommodated object accommodated in the washing tub 10 by applying a stimulus to the accommodated object. Even if no specific sound is sensed by the sound sensor 100, the sound inducer 500 may identify in another way the possibility of an accident occurring by providing a situation for inducing a sound from the object to be protected 30.

That is, even if no sound of the object to be protected 30 is sensed by the sound sensor 100, the situation in which the object to be protected 30 is present in the washing tub 10 in a silent state cannot be excluded. Therefore, it is desirable to be prepared to respond to this situation by inducing a sound from the object to be protected 30.

In this case, the accommodated object refers to an object that is accommodated in the washing tub 10. The accommodated object may conceptually include not only laundry that is likely to be present in the washing tub 10 but also an object to be protected 30 that is likely to be present in the washing tub 10.

Here, the sound inducer 500 may apply a vibration stimulus to the washing tub 10 in order to induce a reaction from the accommodated object accommodated in the washing tub 10. For example, the sound inducer 500 may include a vibration motor, and may vibrate the washing tub 10 while ensuring the safety of the object to be protected 30. Accordingly, when the object to be protected 30 is present in the washing tub 10 without making a sound, the sound inducer 500 may induce a sound from the object to be protected 30 by momentarily surprising the object to be protected 30.

Alternatively, the sound inducer 500 may apply a sound stimulus to the inside of the washing tub 10 in order to induce a reaction from the accommodated object accommodated in the washing tub 10. For example, the sound inducer 500 may include a speaker, and may generate a sound that the object to be protected 30 likes or dislikes (e.g. a mother's voice calling a child's name, a barking sound of another dog, etc.). Accordingly, when an object to be protected 30 is present in the washing tub 10 without making a sound, the sound inducer 500 may induce a sound from the object to be protected 30 by making the object to be protected 30 respond to a sound that the object to be protected 30 likes or dislikes.

Alternatively, the sound inducer 500 may not be separately mounted in the washing machine 1000 according to this embodiment, and may be configured as a component for operating the washing tub 10 such that the washing tub 10 is rotated while ensuring the safety of the object to be protected 30.

Figure 4:
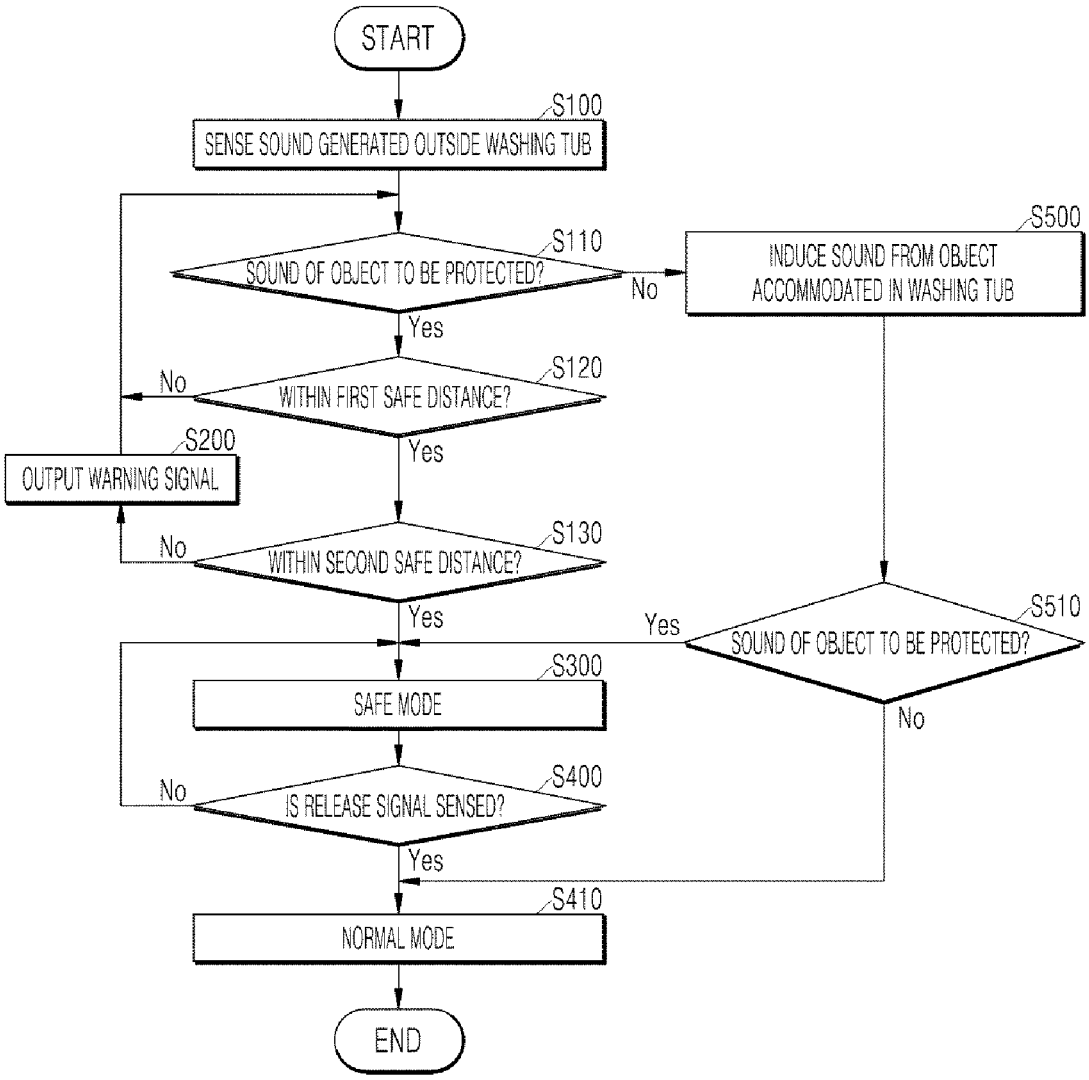
FIG. 4 is a flowchart illustrating a method of controlling a washing machine according to an embodiment of the present disclosure.
Figure 5:
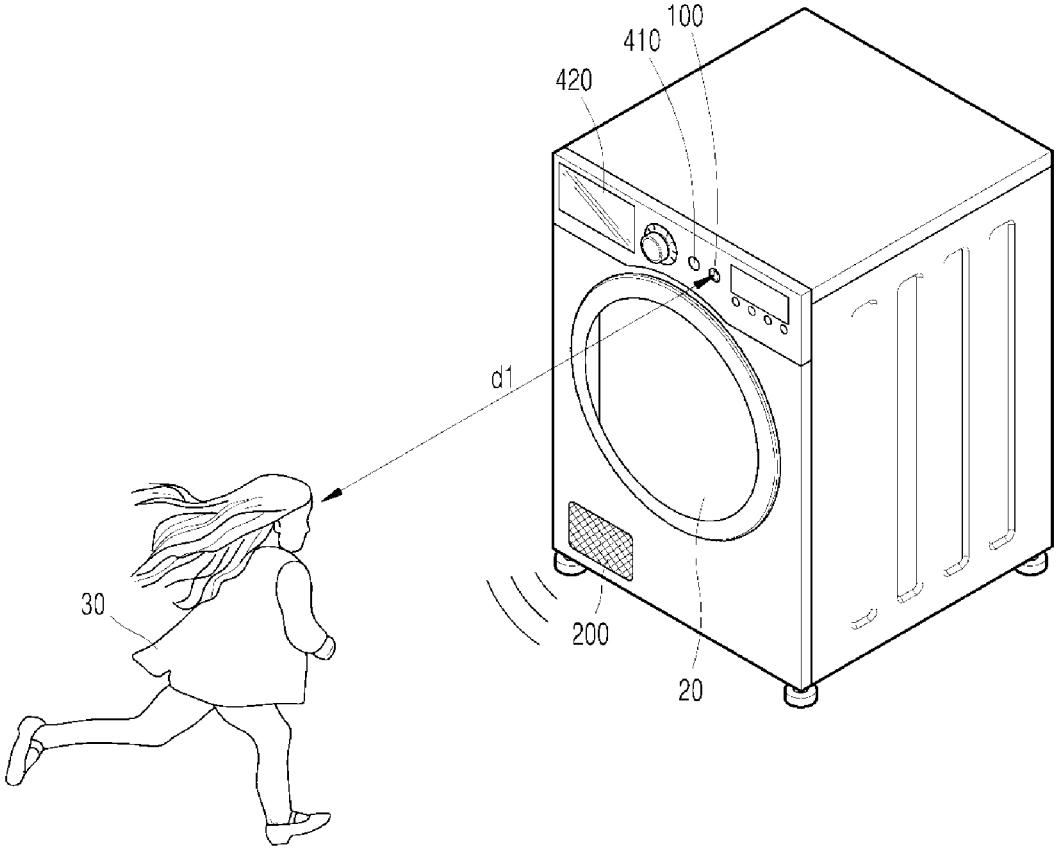
FIG. 5 is a view illustrating a step of outputting a warning signal in the method of controlling a washing machine according to an embodiment of the present disclosure.
Figure 6:
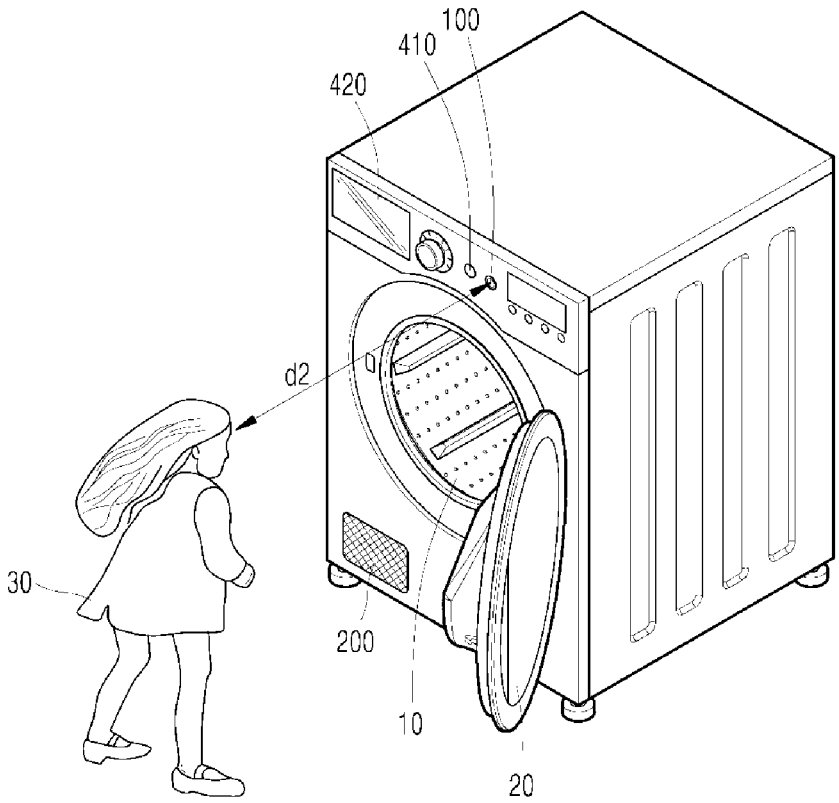
FIG. 6 is a view illustrating a step in which a washing machine is controlled according to a safe mode in the method of controlling a washing machine according to an embodiment of the present disclosure.

FIG. 4 is a flowchart illustrating a method of controlling a washing machine according to an embodiment of the present disclosure. FIG. 5 is a view illustrating a step of outputting a warning signal in the method of controlling a washing machine according to an embodiment of the present disclosure. FIG. 6 is a view illustrating a step in which a washing machine is controlled according to a safe mode in the method of controlling a washing machine according to an embodiment of the present disclosure.

Hereinafter, a method of controlling a washing machine according to an embodiment of the present disclosure will be described with reference to FIGS. 4 to 6. Since a method of controlling a washing machine according to this embodiment is implemented to include the main configuration of the above-described washing machine, reference will be made to FIGS. 1 to 3 in the following description.

Firstly, a sound measured at the washing tub 10 is sensed. That is, the possibility of occurrence of an accident is identified by sensing a sound measured at the washing tub 10.

Here, the method of controlling a washing machine according to an embodiment of the present disclosure will be described with reference to the case in which a sound generated outside the washing tub 10 is sensed (S100). In step S100, a sound generated outside the washing tub 10 is sensed by the sound sensor 100 mounted outside the washing tub 10.

After step S100, whether the sound generated outside the washing tub 10 is a sound of the object to be protected 30 is determined (S110). If the sound of the object to be protected 30 is sensed, this indicates that the object to be protected 30 is present within a predetermined range from the washing tub 10, and this situation is thus treated as involving the possibility of an accident occurring.

Subsequently, the distance of the location of the object to be protected 30 from the washing tub 10 is identified. That is, it is possible to identify the position of the object to be protected 30 based on the distance from which the sound of the object to be protected 30 is sensed.

Here, whether the sound of the object to be protected 30 is measured within a first safe distance is determined (S120). In this case, the first safe distance refers to a distance at which it can be deemed that the object to be protected 30 has not yet come close to the washing tub 10 but that there is a high possibility of the object to be protected 30 approaching the washing tub 10. The first safe distance may be set in advance based on statistics, or may be set by the user in the washing machine 1000 at his or her discretion.

If it is determined that the sound of the object to be protected 30 is measured outside the first safe distance, the situation may be treated as one in which there is no concern related to the object to be protected 30 approaching the washing tub 10.

If the sound of the object to be protected 30 is measured within the first safe distance, whether the sound of the object to be protected 30 is measured within a second safe distance is determined (S130). In this case, the second safe distance refers to a distance at which it can be deemed that the object to be protected 30 has come close to the washing tub 10 and thus that there is a high possibility of an accident occurring. Similar to the first safe distance, the second safe distance may be set in advance based on statistics, or may be set by the user in the washing machine 1000 at his or her discretion. Here, the second safe distance is set to have a smaller value than the first safe distance.

If it is determined that the sound of the object to be protected 30 is measured within the second safe distance, the situation may be treated as one in which immediate measures to ensure the safety of the object to be protected 30 should be taken.

If the sound of the object to be protected 30 is measured within the first safe distance but outside the second safe distance, the situation may be treated as one in which precautionary measures to ensure the safety of the object to be protected 30 should be taken.

Subsequently, a warning signal is output according to sensing of the sound (S200). That is, the warning signal is output in response to the determination that there is the possibility of an accident occurring based on sensing of the sound of the object to be protected 30. In this case, depending on the extent of the accident risk, the warning signal may be selectively controlled to be on or off, or the magnitude of the warning signal may be controlled in stages.

Subsequently, the door 20 and the washing tub 10 are controlled according to the safe mode in response to sensing of the sound (S300). That is, the operation of the washing machine 1000 is restricted to the safe mode in response to the determination that there is the possibility of an accident occurring based on sensing of the sound of the object to be protected 30.

The safe mode is maintained until it is confirmed that the accident risk has been eliminated, such that, even when an object to be protected 30 is present in the washing tub 10, no harm comes to the object to be protected 30.

As described above, according to the method of controlling a washing machine according to this embodiment, when it is determined that there is the possibility of occurrence of an accident based on sensing of the sound measured at the washing tub 10, the warning signal is output, and the door 20 and the washing tub 10 are controlled according to the safe mode, thereby making it possible to effectively prevent the occurrence of an accident related to a child or pet becoming trapped inside the washing tub 10.

Subsequently, a release signal for switching the door 20 and the washing tub 10, which has been controlled according to the safe mode, back to the normal mode is sensed (S400). That is, based on whether a release signal set in advance is sensed, whether the accident risk has been eliminated is determined.

As described above, step S400 may be implemented via the face recognition process, the voice recognition process, or the query-response recognition process, and since sensing of the release signal via such a process can be deemed as confirmation by an authorized user that there is no accident risk, it is possible to switch the washing machine 1000 back to the normal mode without the risk of an accident occurring.

Accordingly, in response to the release signal being sensed in step S400, the door 20 and the washing tub 10 are automatically switched back to the normal mode (S410).

As described above, in the method of controlling a washing machine according to this embodiment, the door 20 and the washing tub 10 are switched back to the normal mode in response to the determination that there is no accident risk based on sensing of a release signal set in advance, and accordingly the washing machine 1000 returns to normal functioning based on reliable grounds, while also allowing such a process to take place easily from the perspective of the user.

The method of controlling a washing machine according to this embodiment may further include a step of inducing a sound from an accommodated object accommodated in the washing tub 10 by applying a stimulus to the accommodated object (S500). When no specific sound is sensed in step S100, a situation for inducing a sound from the accommodated object is provided, and whether the sound induced from the accommodated object is a sound of the object to be protected 30 is determined (S510).

Because there is the possibility in step S100 that an object to be protected 30 is present in the washing tub 10 without making a sound, step S500 is performed to induce a sound from the object to be protected 30, thereby identifying in another way the possibility of an accident occurring.

If it is determined that the induced sound is the sound of an object to be protected 30, this indicates that the object to be protected 30 is present in the washing tub 10, and accordingly this situation is treated as one in which the accident risk is high.

As such, in the method of controlling a washing machine according to this embodiment, a stimulus is applied to an accommodated object accommodated in the washing tub 10 in order to induce a sound from the accommodated object, and whether the induced sound is a sound of an object to be protected is determined, thereby making it possible to more effectively sense the presence of a child or pet in the washing tub 10 even in situations in which it is difficult to sense the child or pet in the washing tub 10.

As illustrated in FIG. 5, in the method of controlling a washing machine according to this embodiment, when the sound of the object to be protected 30 is sensed within the first safe distance, a warning signal indicating an approach to the washing tub 10 may be output in step S200.

As described above, if the sound of the object to be protected 30 is sensed within the first safe distance, it can be deemed that the object to be protected 30 has not yet come close to the washing tub 10 but that there is a high possibility of the object to be protected 30 approaching the washing tub 10. Therefore, a warning signal indicating an approach to the washing tub 10 is output to the object to be protected 30, thereby preventing the object to be protected 30 from coming close to the washing tub 10.

As such, in the method of controlling a washing machine according to this embodiment, when it is determined that the object to be protected 30 is present within the first safe distance from the washing machine 1000 based on sensing of the sound of the object to be protected 30, a warning signal indicating an approach to the washing tub 10 is output, thereby preventing a child or pet from approaching the washing machine 1000.

Furthermore, as illustrated in FIG. 6, in the method of controlling a washing machine according to this embodiment, when the sound of the object to be protected 30 is sensed within the second safe distance, the door 20 is switched to an unlock mode, and the washing tub 10 is switched to a lock mode in step S300.

As described above, if the sound of the object to be protected 30 is measured within the second safe distance, the situation may be treated as one in which immediate measures to ensure the safety of the object to be protected 30 should be taken. Therefore, in order to ensure the safety of the object to be protected 30, the door 20 is switched to an unlock mode, and the washing tub 10 is switched to a lock mode.

Here, the unlock mode of the door 20 refers to a state in which the door 20 is controlled so as not to be closed or locked. Accordingly, when an object to be protected 30 is inside the washing tub 10, the door 20 remains open, thereby preventing the occurrence of an accident.

In addition, the lock mode of the washing tub 10 refers to a state in which operation of the washing tub 10 to perform at least one of a washing process, a rinsing process, a dehydrating process, or a drying process is restricted. Accordingly, when an object to be protected 30 is inside the washing tub 10, the washing tub 10 is incapable of operating, thereby preventing the occurrence of an accident.

As such, in the method of controlling a washing machine according to this embodiment, when it is determined that the object to be protected 30 is present within the second safe distance from the washing machine 1000 based on sensing of the sound of the object to be protected 30, the door 20 is switched to the unlock mode, and the washing tub 10 is switched to the lock mode, thereby preventing the occurrence of an accident due to depletion of oxygen or due to operation of the washing machine 1000 in the state in which a child or pet is inside the washing tub 10.

In the method of controlling a washing machine according to this embodiment, step S500 may include a step of applying a vibration stimulus to the washing tub 10 in order to induce a reaction from an accommodated object accommodated in the washing tub 10.

For example, in step S500, the washing tub 10 may be vibrated while ensuring the safety of the object to be protected 30. Accordingly, when the object to be protected 30 is present in the washing tub 10 without making a sound, it is possible to induce a sound from the object to be protected 30 by momentarily surprising the object to be protected 30.

As such, in the method of controlling a washing machine according to this embodiment, a vibration stimulus is applied to the washing tub 10 in order to momentarily surprise a child or pet that is present in the washing tub 10 without making a sound, thereby effectively inducing a sound from the child or pet.

In addition, in the method of controlling a washing machine according to this embodiment, step S500 may include a step of rotating the washing tub 10 in order to induce a reaction from an accommodated object accommodated in the washing tub 10 using a sound inducer 500.

For example, the sound inducer 500 may not be separately mounted in the washing machine 1000 according to this embodiment, and may be configured as a component for operating the washing tub 10 such that the washing tub 10 is rotated while ensuring the safety of the object to be protected 30.

In addition, in the method of controlling a washing machine according to this embodiment, step S500 may include a step of applying a sound stimulus to the inside of the washing tub 10 in order to induce a reaction from the accommodated object accommodated in the washing tub 10.

For example, in step S500, a sound that the object to be protected 30 likes or dislikes may be generated. Accordingly, when the object to be protected 30 is present in the washing tub 10 without making a sound, it is possible to induce a sound from the object to be protected 30 by making the object to be protected 30 respond to the sound that the object to be protected 30 likes or dislikes.

As such, in the method of controlling a washing machine according to this embodiment, a sound stimulus is applied to a child or pet that is present in the washing tub 10 without making a sound in order to make the child or pet respond to the sound stimulus that he or she may like or dislike, thereby effectively inducing a sound from the child or pet.

Figure 7:
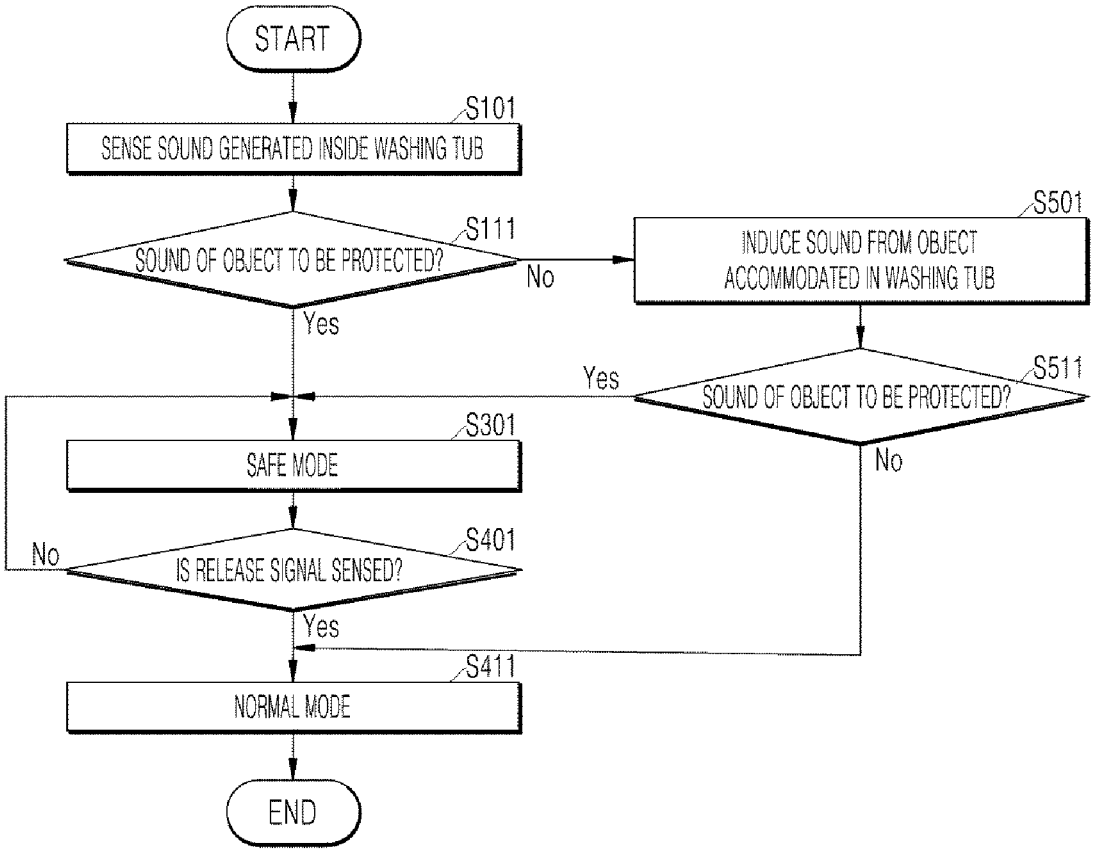
FIG. 7 is a flowchart illustrating a method of controlling a washing machine according to another embodiment of the present disclosure.

FIG. 7 is a flowchart illustrating a method of controlling a washing machine according to another embodiment of the present disclosure.

As illustrated in FIG. 7, a method of controlling a washing machine according to another embodiment of the present disclosure will be described with reference to the case in which a sound generated inside the washing tub 10 is sensed (S101). In step S101, a sound generated inside the washing tub 10 is sensed by the sound sensor 100 mounted inside the washing tub 10.

After step S101, whether the sound generated inside the washing tub 10 is a sound of the object to be protected 30 is determined (S111). If the sound generated inside the washing tub 10 is a sound of the object to be protected 30, this indicates that the object to be protected 30 is present in the washing tub 10, and accordingly this situation is treated as one in which immediate measures to ensure the safety of the object to be protected 30 should be taken.

Subsequently, the door 20 and the washing tub 10 are controlled according to the safe mode in response to sensing of the sound (S301). That is, the operation of the washing machine 1000 is restricted to the safe mode in response to the determination that there is the possibility of an accident occurring based on sensing of the sound of the object to be protected 30.

Subsequently, a release signal for switching the door 20 and the washing tub 10, which has been controlled according to the safe mode, back to the normal mode is sensed (S401). That is, based on whether a release signal set in advance is sensed, whether the accident risk has been eliminated is determined.

In response to the release signal being sensed in step S401, the door 20 and the washing tub 10 are automatically switched back to the normal mode (S411).

The method of controlling a washing machine according to another embodiment may further include a step of inducing a sound from an accommodated object accommodated in the washing tub 10 by applying a stimulus to the accommodated object (S501). When no specific sound is sensed in step S101, a situation for inducing a sound from the accommodated object is created, and whether the sound induced from the accommodated object is a sound of the object to be protected 30 is determined (S511).

As such, in the method of controlling a washing machine according to this embodiment, when it is determined that an object to be protected 30 is present in the washing tub 10 based on sensing of the sound of the object to be protected 30, the door 20 is switched to the unlock mode, and the washing tub 10 is switched to the lock mode, thereby preventing the occurrence of an accident due to depletion of oxygen or due to operation of the washing machine 1000 in the state in which a child or pet is inside the washing tub 10.

With the exception of the above-described configuration and features of the method of controlling a washing machine according to this embodiment of the present disclosure, the method of controlling a washing machine according to this embodiment is the same as or similar to the method of controlling a washing machine according to the embodiment of the present disclosure described previously above. Therefore, a detailed description of the same content is omitted.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this disclosure provided they come within the scope of the appended claims and their equivalents.

According to at least one of the embodiments of the present disclosure, when it is determined that there is the possibility of occurrence of an accident based on sensing of a sound measured at the washing tub, a warning signal is output, and the door and the washing tub are controlled according to the safe mode, thereby making it possible to effectively prevent the occurrence of an accident related to a child or pet becoming trapped inside the washing tub.

In addition, according to at least one of the embodiments of the present disclosure, the door and the washing tub are switched back to the normal mode in response to the determination that there is no risk of an accident based on sensing of a release signal set in advance, and accordingly the washing machine returns to normal functioning based on reliable grounds, while also allowing such a process to take place easily from the perspective of the user.

In addition, according to at least one of the embodiments of the present disclosure, a stimulus is applied to an accommodated object accommodated in the washing tub in order to induce a sound from the accommodated object, and whether the induced sound is a sound of an object to be protected is determined, thereby making it possible to more effectively sense the presence of a child or pet in the washing tub even in situations in which it is difficult to sense the child or pet in the washing tub.

In addition, according to at least one of the embodiments of the present disclosure, a sound generated inside the washing tub and a sound generated outside the washing tub are separately sensed, and thus it is possible to identify the possibility of the occurrence of accidents according to various different situations in a variety of different ways.

In addition, according to at least one of the embodiments of the present disclosure, a vibration stimulus is applied to the washing tub in order to momentarily surprise a child or pet that is present in the washing tub without making a sound, thereby effectively inducing a sound from the child or pet.

In addition, according to at least one of the embodiments of the present disclosure, a sound stimulus is applied to a child or pet that is present in the washing tub without making a sound in order to make the child or pet respond to the sound stimulus that he or she may like or dislike, thereby effectively inducing a sound from the child or pet.

In addition, according to at least one of the embodiments of the present disclosure, when it is determined that an object to be protected is present within the first safe distance from the washing machine based on sensing of the sound of the object to be protected, a warning signal indicating an approach to the washing tub is output, thereby preventing a child or pet from approaching the washing machine.

In addition, according to at least one of the embodiments of the present disclosure, when it is determined that an object to be protected is present within the second safe distance from the washing machine based on sensing of the sound of the object to be protected, the door is switched to the unlock mode, and the washing tub is switched to the lock mode, thereby preventing the occurrence of an accident due to depletion of oxygen or due to operation of the washing machine in the state in which a child or pet is inside the washing tub.

In addition, according to at least one of the embodiments of the present disclosure, when it is determined that an object to be protected is present in the washing tub based on sensing of the sound of the object to be protected, the door is switched to the unlock mode, and the washing tub is switched to the lock mode, thereby preventing the occurrence of an accident due to depletion of oxygen or due to operation of the washing machine in the state in which a child or pet is inside the washing tub.

What is claimed is:

1. A washing machine comprising:

a washing tub;

a door configured to open and close the washing tub;

a sound sensor configured to sense a sound from the washing tub;

a controller configured to, based on the sound sensed by the sound sensor, control the door and the washing tub according to a safe mode;

a release signal sensor configured to, based on the door and the washing tub being controlled according to the safe mode, sense a release signal that is pre-set to be detected by the release signal sensor based on an approach of a user; and a sound inducer configured to apply a stimulus to an object accommodated in the washing tub to thereby induce a sound from the object, wherein the controller is configured to, based on the release signal sensor sensing the release signal, switch the door and the washing tub from the safe mode to a normal mode.

2. The washing machine according to claim 1, further comprising:

a warning signal output interface configured to output a warning signal based on the sound sensed by the sound sensor.

3. The washing machine according to claim 1, wherein the sound sensor comprises:

an outer sound sensor disposed at an outside of the washing tub and configured to sense an outer sound generated from the outside of the washing tub; and an inner sound sensor disposed at an inside of the washing tub and configured to detect an inner sound generated from the inside of the washing tub.

4. The washing machine according to claim 1, wherein the stimulus comprises a vibration stimulus, and the sound inducer is configured to apply the vibration stimulus to the washing tub to thereby induce a reaction from the object in response to the vibration stimulus.

5. The washing machine according to claim 1, wherein the stimulus comprises a sound stimulus, and the sound inducer is configured to apply the sound stimulus to an inside of the washing tub to thereby induce a reaction from the object in response to the sound stimulus.

* * * * *